US008019271B1

(12) United States Patent
Izdepski

(10) Patent No.: US 8,019,271 B1
(45) Date of Patent: Sep. 13, 2011

(54) METHODS AND SYSTEMS FOR PRESENTING INFORMATION ON MOBILE DEVICES

(75) Inventor: Erich J. Izdepski, Reston, VA (US)

(73) Assignee: Nextel Communications, Inc., Reston, VA (US)

( * ) Notice: Subject to any disclaimer, the term of this patent is extended or adjusted under 35 U.S.C. 154(b) by 1153 days.

(21) Appl. No.: 11/647,244

(22) Filed: Dec. 29, 2006

(51) Int. Cl.
*H04H 1/00* (2006.01)

(52) U.S. Cl. ..... 455/3.01; 455/3.06; 455/566; 725/104; 725/82

(58) Field of Classification Search ..... 455/3.01, 455/3.02, 3.06, 13.1, 427, 414.1, 414.2, 552.1, 455/466, 566; 705/10, 14, 14.65; 725/89, 725/88, 102, 86, 31, 82, 32, 36, 42, 87, 104; 715/853, 716; 709/246
See application file for complete search history.

(56) References Cited

U.S. PATENT DOCUMENTS

| | | | | |
|---|---|---|---|---|
| 6,622,007 | B2 * | 9/2003 | Linden | 455/12.1 |
| 2003/0220100 | A1 * | 11/2003 | McElhatten et al. | 455/418 |
| 2006/0294558 | A1 * | 12/2006 | Morris et al. | 725/89 |
| 2007/0016865 | A1 * | 1/2007 | Johnson et al. | 715/716 |
| 2007/0060109 | A1 * | 3/2007 | Ramer et al. | 455/414.1 |
| 2007/0061759 | A1 * | 3/2007 | Klein, Jr. | 715/853 |
| 2007/0118608 | A1 * | 5/2007 | Egli | 709/217 |
| 2008/0086750 | A1 * | 4/2008 | Yasrebi et al. | 725/86 |
| 2008/0090513 | A1 * | 4/2008 | Collins et al. | 455/3.01 |
| 2008/0091845 | A1 * | 4/2008 | Mills et al. | 709/246 |
| 2008/0120652 | A1 * | 5/2008 | Guzman et al. | 725/59 |
| 2008/0155617 | A1 * | 6/2008 | Angiolillo et al. | 725/93 |
| 2008/0200154 | A1 * | 8/2008 | Maharajh et al. | 455/414.3 |
| 2008/0207182 | A1 * | 8/2008 | Maharajh et al. | 455/414.1 |
| 2008/0214150 | A1 * | 9/2008 | Ramer et al. | 455/414.1 |
| 2008/0227385 | A1 * | 9/2008 | Bappu et al. | 455/3.06 |
| 2008/0242279 | A1 * | 10/2008 | Ramer et al. | 455/414.2 |
| 2009/0030774 | A1 * | 1/2009 | Rothschild et al. | 705/10 |
| 2009/0254971 | A1 * | 10/2009 | Herz et al. | 726/1 |
| 2009/0300673 | A1 * | 12/2009 | Bachet et al. | 725/31 |
| 2010/0009722 | A1 * | 1/2010 | Levy et al. | 455/566 |
| 2011/0016231 | A1 * | 1/2011 | Ramaswamy et al. | 709/246 |

* cited by examiner

*Primary Examiner* — Tan Trinh

(57) ABSTRACT

Methods and systems for presenting media content (e.g., scrolling text) on a mobile device are provided. A broadcast may be received from a network via a wireless communication link, the broadcast may include media content (e.g., a text feed) and information (e.g., metadata) associated with characteristics of the media content. The media content may be extracted, and at least one characteristic associated with presenting the media content on the mobile device may be identified. The media content may be presented on the mobile device in accordance with the at least one identified characteristic.

19 Claims, 8 Drawing Sheets

500

METHODS AND SYSTEMS FOR PRESENTING INFORMATION ON MOBILE DEVICES

FIELD OF THE INVENTION

The present invention relates generally to telecommunications, and in particular, to presenting information in a mobile environment.

BACKGROUND

In addition to robust and reliable voice services, mobile device consumers often demand mobile access to real-time multimedia and entertainment content, such a news broadcasts, weather forecasts, sports clips, stock quotes, etc. To meet this increasing consumer demand, various technologies have been developed to provide such content to mobile devices. For example, DVB-H (Digital Video Broadcasting-Handheld), DMB (Digital Multimedia Broadcasting), and MediaFLO™ facilitate mobile reception of multimedia and entertainment content.

Mobile devices that receive real-time multimedia content must be able to receive, process, and properly display such content to users. Existing technologies for receiving and displaying such content on mobile devices, however, are deficient in several aspects. In particular, existing technologies are deficient in their ability to properly display scrolling text during a real-time video broadcast, such as the ticker (or text crawl) accompanying CNN's Headline News.

Displaying such scrolling text on mobile devices usually involves scrolling the text during a video presentation. While adequate for normal television viewing on relatively large screens, problems with readability occur when those or similar videos are presented on smaller, mobile devices. The low frame rate of scrolling text presentations exacerbate the problem, often making the text appear erratic and lowering the overall quality of the viewing experience. FIGS. 1A-1C illustrate typical mobile video displays with scrolling text. FIG. 1A illustrates a screen shot 100 of a typical QCIF (Quarter Common Intermediate Format) mobile video display with scrolling text 105. FIG. 1B illustrates a screen shot 110 representative of a typical QVGA (Quarter-VGA) mobile video display with scrolling text 115. FIG. 1C illustrates a screen shot 120 of QCIF video enlarged to QVGA, which is typical of viewing mobile video in a full screen mode. As illustrated, there are readability problems even when scrolling text is enlarged to QVGA.

Some attempts have been made to improve readability of text on mobile device by increasing the text font. These attempts, however, are usually restricted to static text feed with a video signal. In addition, these attempts are typically limited to pre-recorded video and not real-time broadcasts.

SUMMARY

Systems, apparatus, methods and computer-readable media consistent with the present invention may obviate one or more of the above and/or other issues. In one example, systems, apparatus, methods and computer-readable media are provided for displaying scrolling text on a mobile device in a manner that is easily perceived by a user.

Consistent with the present invention, a method for presenting media content on a mobile device is provided. The method may comprise: receiving a broadcast from a network via a wireless communication link, the broadcast including media content and metadata associated with characteristics of the media content; extracting the media content from the broadcast; identifying from the metadata at least one characteristic associated with presenting the media content on the mobile device; and presenting the media content on the mobile device in accordance with the at least one identified characteristic.

Consistent with the present invention, a method for broadcasting information for presentation on a mobile device is provided. The method may comprise: receiving program content and supplemental media content from at least one content provider; generating metadata corresponding to the received supplemental media content, wherein the metadata includes information associated with presenting the supplemental content to a user; and transmitting the received program content, the supplemental media content, and the metadata over a wireless network for reception by the mobile device, wherein the supplemental media content and the metadata are transmitted independent of the program content. In one implementation, an aggregator may receive the program content and supplemental content, generate metadata, and then broadcast the information for reception by a mobile device.

Consistent with the present invention, a portable communication device is provided. The device may comprise: a receiver module configured to receive a broadcast from a wireless network, the broadcast including markup language documents representing a media content feed; a processing module configured to extract media content and interpret the markup language documents; and a presentation module configured to present the extracted media content in accordance with the interpreted markup language documents.

The foregoing background and summary are not intended to be comprehensive, but instead serve to help artisans of ordinary skill understand implementations consistent with the present invention set forth in the appended claims. The foregoing background and summary are not intended to provide any independent limitations on the claimed invention or equivalents thereof.

BRIEF DESCRIPTION OF THE DRAWINGS

The accompanying drawings show features of implementations consistent with the present invention and, together with the corresponding written description, help explain principles associated with the invention. In the drawings.

DETAILED DESCRIPTION

The following description refers to the accompanying drawings, in which, in the absence of a contrary representation, the same numbers in different drawings represent similar elements. The implementations set forth in the following description do not represent all implementations consistent with the claimed invention. Other implementations may be used and structural and procedural changes may be made without departing from the scope of present invention.

Overview

Figure 1A:
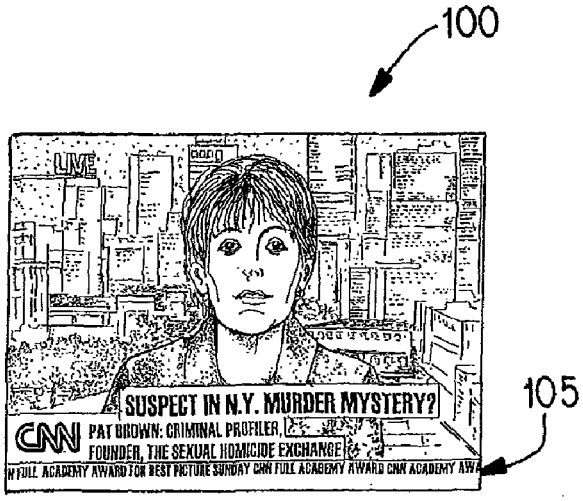
FIGS. 1A-1C illustrate exemplary screen shots of conventional mobile video displays.
Figure 1B:
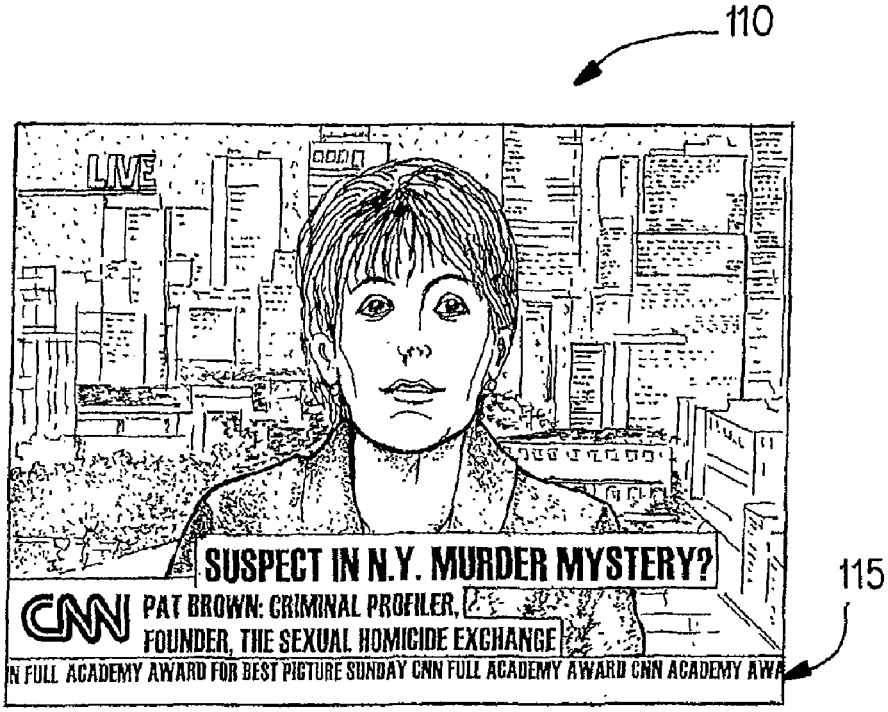
Figure 1C:
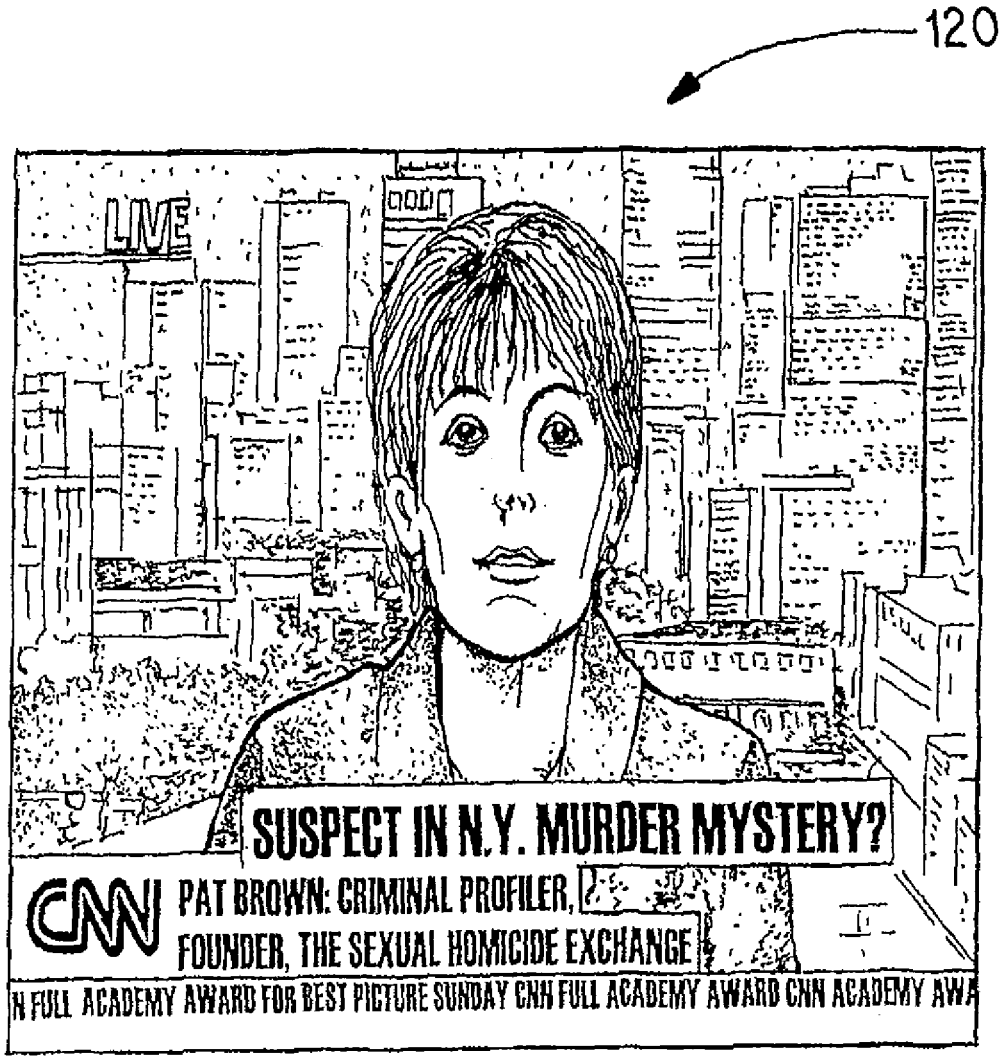
Figure 2:
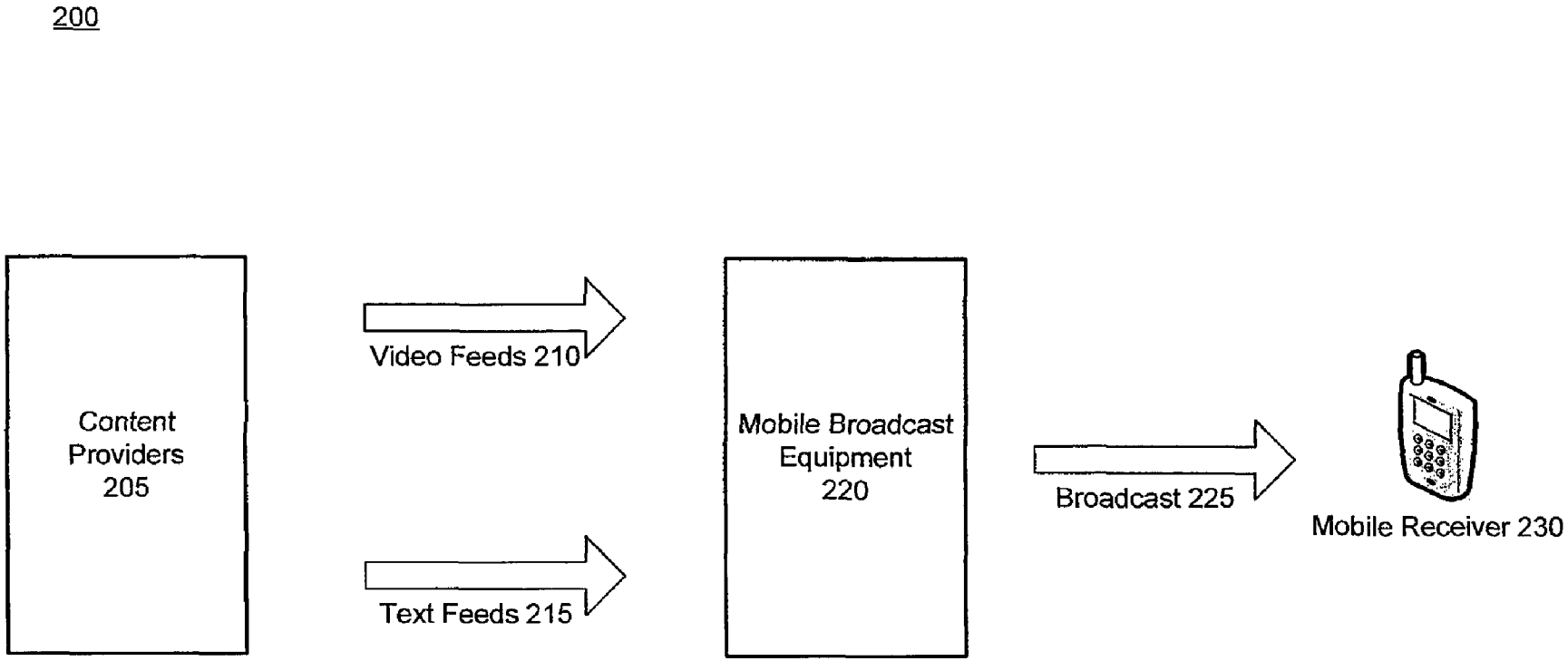
FIG. 2 illustrates an exemplary data flow diagram consistent with the present invention.

FIG. 2 illustrates an exemplary data flow diagram 200 consistent with one particular implementation of the present invention. As illustrated, video feeds 210 and text feeds 215 originating from content providers 205 (e.g., television program providers) may be provided to mobile broadcast equipment 220. Content providers 205 may aggregate video and/or text feeds (210, 215) for various channels and provide this data to mobile broadcast equipment 220. Broadcast equipment 220 may be configured for IP (Internet Protocol) datacasting and include a data carousel. Broadcast equipment 220 may receive the video and text feeds (210, 215) independently and combine them to form a single RF broadcast 225, which may be transmitted over a suitable network for receipt by a mobile receiver 230. Mobile receiver 230 may include various logic and intelligence for obtaining and processing broadcast 225 and also for displaying and manipulating audio and video, including video feeds 210 and text feeds 215.

An eXtensible Markup Language (XML) or other markup language format may be used for controlling the display of text feeds 215 on mobile receiver 230. Logic and intelligence may provided (e.g., in content providers 205 and/or equipment 220) for generating XML documents that include text feeds 215 and also information, such as metadata, associated with characteristics of the text feeds. The characteristics may include, for example, channel associations, expiration dates, display times, etc. This information may be used by mobile receiver 230 to display text feeds 215. Mobile receiver 230 may receive XML documents from mobile broadcast equipment 220, interpret and process the received documents, and display the text contained in the files in accordance with the characteristics included in the interpreted documents.

For purposes of readability, mobile receiver 230 may display text feeds 215 in a non-scrolling or non-continuous manner. For example, receiver 230 may display text in discrete static chunks, each of which may be displayed for a pre-determined amount of time (e.g., 10 seconds). Mobile receiver 230 may also provide various user-controllable display features. For example, mobile receiver 230 may allow a user to configure the appearance (e.g., size, font, contrast, etc.) of displayed text, navigate through displayed text, and activate and de-activate text feeds. It may also allow users to overlay text feeds from one channel onto another channel. For example, a user could view a text feed from one channel (e.g., stock quotes) while viewing video from another channel (e.g., a soccer game). Mobile receiver 230 may also search various text feeds for user-specified keywords and automatically tune to those channels in which the keywords are found.

The foregoing description of FIG. 2 is intended to introduce and provide initial clarity for an exemplary implementation of the present invention. Further details of such an implementation as well as additional aspects and implementations of the present invention will be described below in connection with FIGS. 3-7.

Exemplary Mobile Environment

Figure 3:
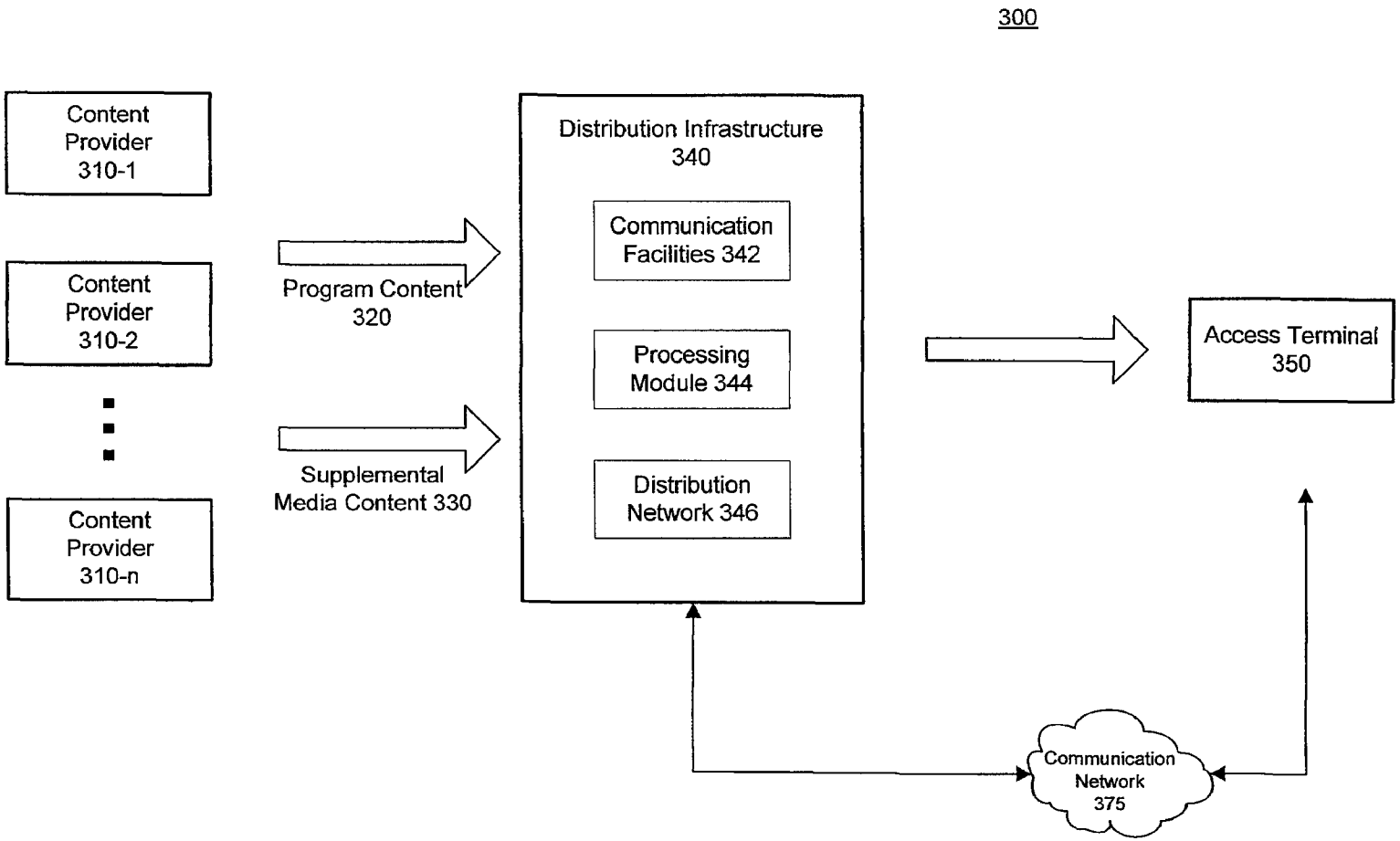
FIG. 3 illustrates an exemplary implementation of a mobile environment consistent with the present invention.

FIG. 3 illustrates an exemplary configuration of a mobile environment 300 consistent with the present invention. Mobile environment 300 may include various systems and elements for providing mobile access to various information, such as real-time audio, video, and text. As illustrated in FIG. 3, mobile environment 300 may comprise one or more content providers 310(1)-310(*n*), a distribution infrastructure 340, an access terminal 350, and a communication network 375.

Content providers 310(1)-310(*n*), which may be similar to content providers 205 in FIG. 2, may include any entities configured to transmit or otherwise provide program content 320 and/or supplemental media content 330 to distribution infrastructure 340. In one configuration, a content provider 310(*n*) may own and/or aggregate program content 320 and/or supplemental media content 330. Content providers 310(1)-310(*n*) may include various systems, networks, and facilities, such as television service providers (e.g., BBC, MTV, CNN, etc.), media studios or stations, etc. Mobile environment 300 may include any number of content providers 310(1)-310(*n*), which may be individually configured and geographically dispersed.

The term "program content" refers to any audio and/or video information (e.g., informative or for entertainment) provided by content providers 310(1)-310(*n*) for reception by users of access terminal 350. Program content 310 may include various television programs, such as CNN Headline News. Referring back to FIG. 2, program content may include one or more video feeds 210.

The term "supplemental media content" (or simply "media content") refers to one or more media objects generated for display on access terminal 350, for example, concurrently with a particular program content 320. Supplemental media content may include, for example, stock ticker and price information, advertisements, news information (e.g., the text crawl accompanying CNN's Headline News), data associated with closed captioning, etc. Supplemental media content is not limited to text and may include various audio and/or video objects. Supplemental media content may also include one or more interactive elements. For example, supplemental media content may include program code and/or one or more http hyperlinks that launch a web browser on access terminal 350. Referring again to FIG. 2, supplement media content may include one or more text feeds 215.

Supplemental media content 330 may be associated with and/or supplement program content 320. For example, a text feed containing stock tickers and prices could be media content that supplements an audio/video feed containing a television news program, which would be program content. As another example, the text crawl accompanying CNN's Headline News could be media content that supplements a audio/video feed containing CNN's Headline News, which would be program content. In yet another example, data found in closed captioning may be media content that supplements a television program, which would be program content.

In one configuration, content providers 310 may be configured to generate and/or provide accompanying information associated with supplemental media content 330 along with the supplemental media content 330. In other configurations, as discussed further below, distribution infrastructure 340 (instead of or in conjunction with content providers 310) may generate the accompanying information.

The "accompanying" information may include information, such as metadata, associated with characteristics of supplemental media content 330 and/or program content 320. These "characteristics" may include any information associated with supplemental media content 330 that can be used by distribution infrastructure 340 and/or mobile access terminal 350 to handle, route, and/or display supplemental media content 330. For example, characteristics may include associations between supplemental media content 330 and related channels, associations between supplemental media content 330 and related program content 320, expiration dates for supplemental media content 330, display times for content, etc. The characteristics may also indicate a particular display type or feature to employ when displaying the supplemental media content. The characteristics may serve to indicate the manner in which program content 320 and/or supplemental media content 330 should be displayed by access terminal 350.

In addition to information associated with characteristics of supplemental media content 330, the accompanying information associated with supplemental media content 330 may optionally include other information, which could be associated with other data and/or systems. For example, the accompanying information may include any information that can be used to handle, route, and/or display supplemental media content 330, program content 320, and/or other information. The accompanying information could also include one or more interactive elements, such as program code and/or http hyperlinks, which may trigger some action on access terminal 350, such as launching a web browser.

Additionally or alternatively, the accompanying information may include discovery information associated with supplemental media content 330. This "discovery" information may include any information obtained or discovered using the supplemental media content. For example, the discovery information may include search results obtained using supplemental media content 330. Additional details of such discovery information are discussed below in connection with distribution infrastructure 340.

In one example, XML or other markup language documents may be used to communicate the accompanying information, such as the information associated with supplemental media content characteristics. For example, one or more content providers 310(1)-310(*n*) (or distribution infrastructure 340) may generate XML or other markup language documents. These documents may contain supplemental media content 330 as well as metadata reflecting characteristics of the media content 330 and any other accompanying information or elements. Mobile access terminal 350 may receive and interpret these documents to properly display received supplemental media content 330.

Content providers 310(1)-310(*n*) may provide program content 320 and/or supplemental media content 330 (or XML files) to infrastructure 340 via various communication links (not shown), such as conventional telecommunication links known in the art. Content providers 310(1)-310(*n*) may include various codecs (e.g., MPEG, AAC, Vorbis, WMA, WMV, SMV, etc.) and/or endecs (ADCs, DACs, stereo generators, etc.) and may provide information to distribution infrastructure 340 in various formats. In one example, program content 320 and supplemental media content 330 may be provided in a digital format, such as an MPEG format.

In one configuration, content providers 310(1)-310(*n*) may provide data to distribution infrastructure 340 in various communication channels and/or may utilize IP datacasting technologies. As an example, content providers 310(1)-310(*n*) may provide program content 320 in a first channel and supplemental media content 330 (or XML files) in a second channel, each channel being independent of the other and both channels being within an allocated spectrum. Additionally, one or more content providers 310(1)-310(*n*) may include various software and/or hardware to identify and aggregate program content 320 and supplemental media content 330 for various channels and/or sources and provide this data to distribution infrastructure 340.

Distribution infrastructure 340 may include various components for receiving video and text feeds from content providers 310(1)-310(*n*) and distributing this and other data to access terminal 350. With reference to FIG. 2, various functionality of mobile broadcast equipment 220 may be embodied by distribution infrastructure 340. As illustrated in FIG. 3, distribution infrastructure 340 may include communication facilities 342, a processing module 344, and a distribution network 346.

Communication facilities 342 may include various components for receiving program content 320 and supplemental media content 330 from content providers 310(1)-310(*n*) and distributing data to access terminal 350. Communication facilities 342 may include one or more components known in the art for performing encoding, compression, modulation, error correction, tuning, scanning, transmission, reception, etc. Communication facilities 342 may also include suitable components (e.g., encoders, transmitters, modulators, mixers, microprocessors, etc.) for merging program content 320 and supplemental media content 330 into a single RF broadcast for receipt by access terminal 350.

In one embodiment, communication facilities 342 may facilitate IP datacasting and include one or more datacasting and file transport components, such as a data carousel and various IP modules. Communication facilities 342 may also include one or more components associated with DVB-H, MediaFLO™, WiMAX (Worldwide Interoperability for Microwave Access), and/or other content delivery technologies and standards. For example, communication facilities 342 may include one or more modulators or other suitable devices for modulating a transport stream (e.g., an MPEG-2 transport stream) onto a DVB-H compliant COFDM (Coded Orthogonal Frequency Division Multiplexing) or other suitable spectrum. Communication facilities 342 may include suitable components for receiving the transport stream as input from one or more content providers 310(1)-310(*n*) and/or one or more other components in distribution infrastructure 340, such as processing module 344.

Processing module 344 may include various hardware, software, and/or firmware for processing program content 320 and supplemental media content 330. Processing module 344 may determine associations and relationships between program content 320 and supplemental media content 330. In certain configurations, processing module 344 (instead of or in conjunction with content providers 310) may serve as an aggregator for program content and/or supplemental content for various channels. Additionally, processing module 344 (in conjunction with or independently of content providers 310) may determine and/or generate accompanying information for program content 320 and/or supplemental media content 330. Such characteristics, as noted above, may indicate the manner in which program content 320 and/or supplemental media content 330 should be displayed by access terminal 350. As noted above, these characteristics may include channel associations, expiration dates, display times, etc. for supplemental media content 330. Processing module 344 may also determine and/or generate any interactive elements and any other accompanying information.

As noted above, the accompanying information associated with supplemental media content 330 may include discovery information, such as search results. Processing module 344 may include and/or leverage one or more components to generate or obtain this discovery information. For example, processing module 344 may use text-to-speech or other suitable modules to manipulate, interpret, and/or analyze incoming supplemental media content 330 received from content providers 310. In one configuration, processing module 344 may obtain keywords from incoming supplemental media content 330 and use these keywords to obtain search results, such as Internet and/or database search results. In such a configuration, processing module 344 may include and/or leverage one or more search engines or other suitable logic. Processing module 344 may organize the search results and provide the search results as accompanying information.

In one configuration, processing module 344 may generate (in conjunction with or independently of content providers **310(1)-310(*n*)) XML or other markup language files for receipt by access terminal 350. The generated XML files may contain supplemental media content 330 as well as metadata associated with characteristics (channel associations, expiration dates, display times, etc.) of the supplemental media content. The XML files may also include any other optional accompanying information, such as interactive elements (e.g., hyperlinks), discovery information (Internet search results), etc. Such information could be part of the supplemental media content provided by content providers 310 or, alternatively, could be added by processing module 344**.

Although depicted as separate from communication facilities 342, processing module 344 may interact with, or even be embedded in, components of communication facilities 342, or vice versa. In operation, processing module 344 may interact with content providers **310(1)-310(*n*) and communication facilities 342 to transmit information to access terminal 350 over distribution network 346**.

Distribution network 346 may include any suitable structure for transmitting data from distribution infrastructure 340 to access terminal 350. In one configuration, distribution network 346 may facilitate communication in accordance with DVB-H, MediaFLO,™ WiMAX, and/or other content delivery technologies and standards. Distribution network 346 may include a unicast, multicast, or broadcasting network. Distribution network 346 may include a broadband digital network. Distribution network 346 may employ communication protocols such as User Datagram Protocol (UDP), Transmission Control and Internet Protocol (TCP/IP), Asynchronous Transfer Mode (ATM), SONET, Ethernet, DVB-H, DVB-T, or any other compilation of procedures for controlling communications among network locations. Further, in certain embodiments, distribution network 346 may include optical fiber, Fibre Channel, SCSI, and/or iSCSI technology and devices.

Access terminal 350 may include any system, device, or apparatus suitable for remotely accessing elements of mobile environment 300 and for sending and receiving information to/from those elements. Access terminal 350 may include a mobile computing and/or communication device (e.g., a cellular phone, a laptop, a PDA, a Blackberry™, an Ergo Audrey™, etc.). Alternatively, access terminal 350 may include a general-purpose computer, a server, a personal computer (e.g., a desktop), a workstation, or any other hardware-based processing systems known in the art. In another example, access terminal 350 may include a cable television set top box or other similar device. Mobile environment 300 may include any number of geographically-dispersed access terminals 350, each similar or different in structure and capability.

In certain configurations, distribution infrastructure 340 may provide one-way data distribution to access terminal 350. That is, distribution infrastructure 340 may provide information to access terminal 350 but may not be operable to receive return communications from access terminal 350. In such configurations, mobile environment 300 may optionally include communications network 375.

Communications network 375 may serve as a mobile network (e.g., a radio or cellular network) and allow access terminal 350 to communicate with distribution infrastructure 340 and/or other entities, such as third party entities. In one configuration, communications network 375 may include a wireless broadband network. Communications network 375 may include various elements known in the art, such as cell sites, base stations, transmitters, receivers, repeaters, etc. It may also employ various technologies and protocols, such as FDMA (Frequency Division Multiple Access); CDMA (Code Division Multiple Access) (e.g., 1xRTT, 1xEV-DO, W-CDMA); continuous-phase frequency shift keying (such as Gaussian minimum shift keying (GMSK)), various 3G mobile technologies (such as Universal Mobile Telecommunications System (UMTS)), etc.

Figure 4:
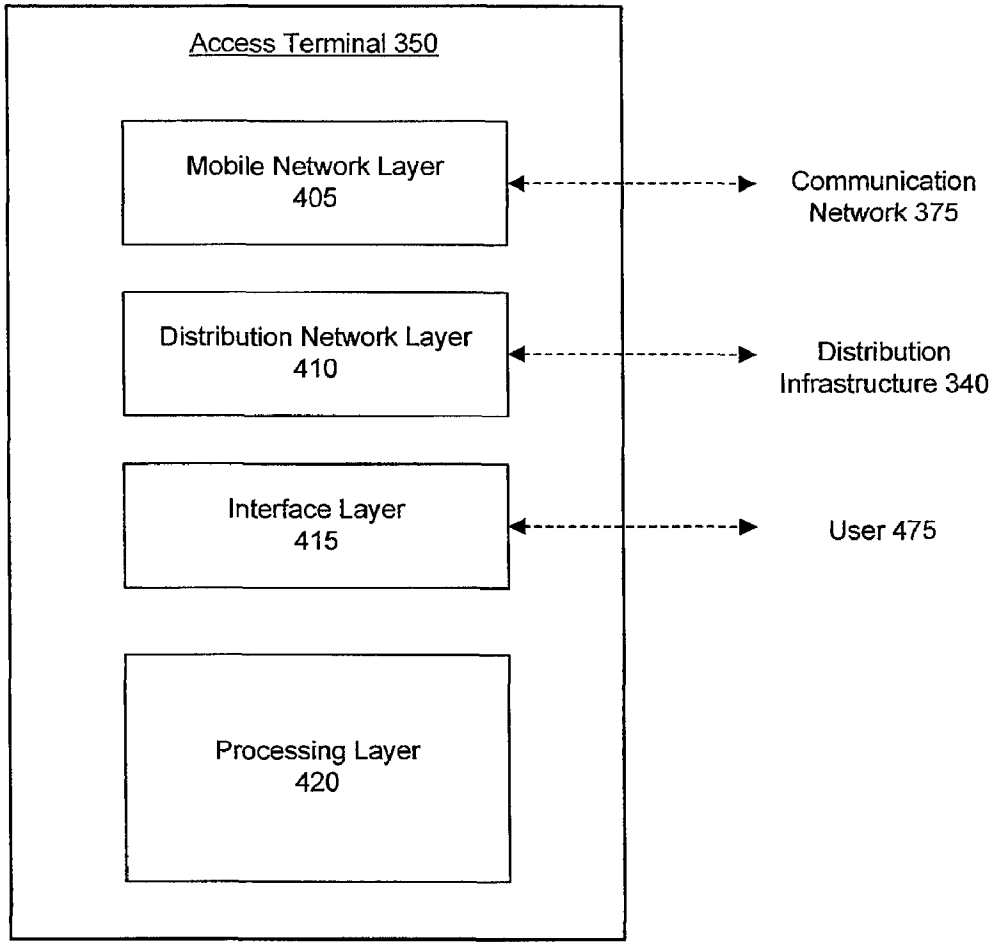
FIG. 4 illustrates an exemplary implementation of an access terminal consistent with the present invention.

FIG. 4 illustrates an exemplary implementation of access terminal 350 consistent with the present invention. Access terminal 350 may include various hardware, software, and/or firmware. As illustrated in FIG. 4, one particular configuration of access terminal 350 includes a mobile network layer 405, a distribution network layer 410, an interface layer 415, and a processing layer 420. Each of layers 405, 410, 415, and 420 may be implemented in a combination of hardware, software, and/or firmware. Access terminal 350 may include various I/O, display, storage, processing, and network components known in the art, which may be included in or used by layers 405, 410, 415, and 420. In addition, access terminal 350 may include an operating system and various user applications, such as web browsers, games, address books, organizers, word processors, etc.

Mobile network layer 405 may include suitable components for allowing access terminal 350 to interact with communications network 375. Mobile network layer 405 may include various RF components for receiving information from and sending information to network 375. It may include various known network communication and processing components, such as an antenna, a tuner, a transceiver, etc. Mobile network layer 405 may also include one or more network cards and/or data and communication ports.

Distribution network layer 410 may include suitable components for allowing access terminal 350 to receive communications from distribution infrastructure 340. In certain configurations, distribution network layer 410 may allow access terminal 350 to receive digital video broadcasts and/or IP datacasting broadcasts. Distribution network layer 410 may include various network communication and processing components, such as an antenna, a tuner, a receiver (e.g., a DVB receiver), a demodulator, a decapsulator, etc. In operation, distribution network layer 410 may tune to channels and receive information from distribution infrastructure 340. Distribution network layer 410 may process received digital transport streams (e.g., demodulation, buffering, decoding, error correction, de-encapsulation, etc.) and pass IP packets to an IP stack in an operating system (e.g., in processing layer 420) for use by applications.

Interface layer 415 may include various hardware, software, and/or firmware components for facilitating interaction between access terminal 350 and a user 475, which could include an individual or another system. Interface layer 415 may provide one or more Graphical User Interfaces and provide a front end or a communications portal through which user 475 can interact with functions of access terminal 350. Interface layer 415 may include and/or control various input devices, such as a keyboard, a mouse, a pointing device, a touch screen, etc. It may also include and/or control various output devices, such as a visual display device and an audio display device. Interface layer 415 may further include and/or control audio- or video-capture devices, as well as one or more data reading devices and/or input/output ports.

Processing layer 420 may receive information from, send information to, and/or route information among elements of access terminal 350, such as mobile network layer 405, distribution network layer 410, and interface layer 415. Processing layer 420 may also control access terminal elements, and it may process and control the display of information received from such access terminal elements.

Processing layer 420 may include one or more hardware, software, and/or firmware components. In one implementation, processing layer 420 may include one or more memory devices (not shown). Such memory devices may store program code (e.g., XML, HTML, Java, C/C++, Visual Basic, etc.) for performing all or some of the functionality (discussed below) associated with processing layer 420. The memory devices may store program code for various applications, an operating system (e.g., Symbian OS, Windows Mobile, etc.), an application programming interface, application routines, and/or other executable instructions. The memory devices may also store program code and information for various communications (e.g., TCP/IP communications), kernel and device drivers, and configuration information.

Processing layer 420 may also include one or more processing devices (not shown). Such processing devices may route information and execute instructions included program code stored in memory. The processing devices may be implemented using one or more general-purpose and/or special-purpose processors.

Processing layer 420 may interact with distribution network layer 410 to receive program content 210 and supplemental media content 330. Processing layer 420 may include various mobile broadcasting (e.g., DVB, DMB, MediaFLO™, WiMAX, etc.) and IP datacasting components, which may interact with distribution network layer 410. For example, processing layer 420 may include components for performing decoding, and time slicing operations. Processing layer 420 may also include one or more IP modules known in the art, which may perform, for example, handshaking, deencapsulation, delivery, sequencing, etc. Such IP modules may interact with corresponding modules in distribution network layer 410, which may be configured for transmitting IP packets.

Processing layer 420 may be configured to process and control the display of supplemental media content 330 and/or program content 320, which may be received from distribution network layer 410. Processing layer 420 may include one or more codecs and/or endecs for processing received content, such as MPEG codecs for processing digital video and/or audio. Processing layer 420 may also include various logic and intelligence for identifying and interpreting characteristics (e.g., channel associations, expiration dates, etc.) of received supplemental media content 330, as well as any interactive elements, discovery information, or other accompanying information. For example, processing layer 420 may include one or more software modules for receiving and interpreting XML or other markup language documents from distribution network layer 410. These documents may include such characteristics for supplemental media content 330. Processing layer 420 may control the display of supplemental media content 330 in accordance with interpreted characteristics (and any other information or elements).

Processing layer 420 may control the display of supplemental media content 330 such that it is displayed in a manner that is easily perceived by user 475. As an example, processing layer 420 may control the display of scrolling text such that it is displayed in discrete static chunks. Each chunk may include a specific number of lines of text (e.g., two lines) and may be displayed for a pre-determined amount of time (e.g., ten seconds). Processing layer 420 may perform various filtering, expansion, and condensing of text (and other media content) as appropriate for the particular display used.

Processing layer 420 may also include one or more text-to-speech modules and one or more voice recognition and/or synthesis modules, which may be multi-lingual. Such modules may convert textual supplemental media content to audible voice signals and present the signals to user 475 via interface layer 415.

The particular display types and features used could be indicated and triggered by various characteristics, interactive elements, or other information accompanying supplemental media content 330, for example, in received XML documents. Alternatively, the particular display types and features may be determined by processing layer 420 itself or by processing layer 420 in conjunction with other components and information, such as interface layer 415 and received user commands.

Processing layer 420 may also control the display of supplemental media content 330 so as to provide various user-controllable display features. Processing layer 420 may initially activate the display of supplemental media content 330 using default settings and display the content with its associated program content 320 (if any). Processing layer 420 may allow user 475 to customize and configure the presentation of displayed supplemental media content, for example, by specifying a text size, a font style, a contrast ratio, a language, an audio signal volume, an audio signal tone (e.g., equalizer settings, male or female, etc.), an audio signal speed, etc. It may also allow user 475 to navigate through displayed supplemental media content, and activate and deactivate (i.e., turn on and off) such content. Processing layer 420 may also allow user 475 to re-perceive, e.g., re-read or re-play, presented supplemental media content 330 and/or to control the presentation of content over a predetermined period or a specific segment of programming. For example, user 475 can read or listen to (at one time) all the headlines from a news broadcast which have been fed over the past hour.

Processing layer 420 may also allow user 475 to overlay supplemental media content 330 from one channel onto another channel. For example, user 475 could overlay supplemental media content 330 (e.g., stock prices) from a first channel onto a program content 320 (e.g., a soccer game) from a second channel different than the first channel. In addition, processing layer 420 may include one or more search engines for searching various streams/channels of supplemental media content 330 available from distribution infrastructure 340. For example, processing layer 420 may search available text feeds for user-specified keywords and cause distribution network layer 410 to tune to those channels in which the keywords are found. In one configuration, to perform searching, processing layer 420 may store or maintain a log of portions of received supplemental media content from a predetermined number of channels in one or more internal or external databases (not shown). For example, processing layer 420 may store content received from the last 10 channels. Processing layer 420 may then search this stored content for keywords. If the keyword is found in the stored content, processing later 420 may control distribution network layer 410 to tune to the channel associated with the content having the match.

For purposes of explanation only, certain aspects of the present invention are described herein with reference to the elements and components illustrated in FIGS. 2-4. The illustrated elements and their configurations are exemplary only. Other variations in the number and arrangement of components are possible, consistent with the present invention. Further, depending on the implementation, certain illustrated elements may be absent and/or additional components not illustrated may be present. In addition, some or all of the functionality of the illustrated components may overlap and/or exist in a fewer or greater number of components than what is illustrated.

Exemplary Broadcasting and Presenting Processes

Figure 5:
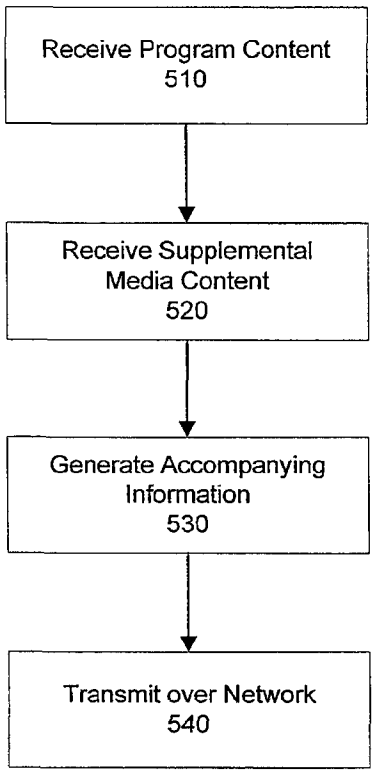
FIG. 5 illustrates an exemplary broadcasting process consistent with the present invention.

FIG. 5 illustrates an exemplary broadcasting process 500 consistent with the present invention. As illustrated, process 500 may comprise receiving program content (510), receiving supplemental media content (520), generating accompanying information associated with the supplemental media content (530), and transmitting at least one of the program content, the supplemental media content, and the generated accompanying information over a network (540).

Broadcasting process 500 may include receiving program content (510). This may involve receiving program content 320 from one or more content providers 310(1)-310(*n*), which may generate and/or aggregate program content for various channels. Distribution infrastructure 340, for example, may receive program content 320 from one or more content providers 310(1)-310(*n*). Program content may be received over various communication links and in various formats. For example, program content 320 may be received wirelessly and in an analog or digital format. Receiving program content (510) may include receiving one or more video feeds, such as video feeds 210.

Broadcasting process 500 may also include receiving supplemental media content (520). This may include, for example, receiving supplemental media content 330 from one or more content providers 310(1)-310(*n*). Distribution infrastructure 340, for example, may receive supplemental media content 330 from one or more content providers 310(1)-310(*n*). As with program content, content providers 310(1)-310(*n*) may generate and/or aggregate supplemental media content for various channels and transmit the content, for example, to distribution infrastructure 340. Receiving supplemental media content (520) may include receiving one or more text feeds (e.g., text feeds 215), which may be associated with the received program content, such as a corresponding video feed (e.g., video feeds 210).

Receiving supplemental media content (520) may occur independently of receiving program content (510). That is, supplemental media content may be received independent of its associated program content. Content providers 310(1)-310(*n*), for example, may transmit to distribution infrastructure 340 supplemental media content independently of associated program content. This may be accomplished using IP data delivery techniques (e.g., datacasting) known in the art.

Once the supplemental media content is received, accompanying information associated with the supplemental media content may be generated (530). This may involve generating information (e.g., metadata) associated with one or more characteristics of the supplemental media content, such as channel associations, expiration dates, associations with program content, etc. This generating (530) may also involve generating interactive elements, discovery information, and/or any other accompanying information.

In one example, distribution infrastructure 340 may generate the accompanying information after receiving the supplemental media content. Alternatively, however, the accompanying information could be transmitted with the supplemental media content from content providers 310(1)-310(*n*). In one embodiment, generating accompanying information associated with supplemental media content (530) may comprise establishing an XML or other markup language format and generating markup language documents in accordance with the established format. These documents may include the supplemental media content itself along with the accompanying information. The generating stage (510) may comprise generating a single document including the supplemental media content and the accompanying information. Alternatively, the generating stage (510) may comprise segmenting the supplemental media content and generating a plurality of documents that collectively carry all or a portion of the supplemental media content and the accompanying information.

After the accompanying information is generated, at least one of the program content, the supplemental media content, and the generated accompanying information may be transmitted over a network (540) for reception by a user device, such as access terminal 350. This transmitting stage (540) may involve transmitting program content 320, supplemental media content 330, and accompanying information as digital data over distribution network 346. It may also involve combining or modulating the program content, the supplemental media content, and the accompanying information for transmission over an appropriate network. Distribution infrastructure 340 may perform such operations.

The transmitting stage (540) may include transmitting to a user device, such as access terminal 350, supplemental media content and accompanying information (e.g., in XML documents) independently of program content. That is, while supplemental media content may be associated with program content (e.g., the text crawl accompanying CNN's Headline News), the supplemental media content (text crawl) and the characteristics information (and any other accompanying information) may be transmitted independently of the associated program content (CNN's Headline News program). This may be accomplished using video broadcasting (e.g., DVB-H or MediaFLO™) and IP datacasting technologies, where the supplemental media content and accompanying information are transmitted as ancillary IP packets independent of the associated program content.

Figure 6:
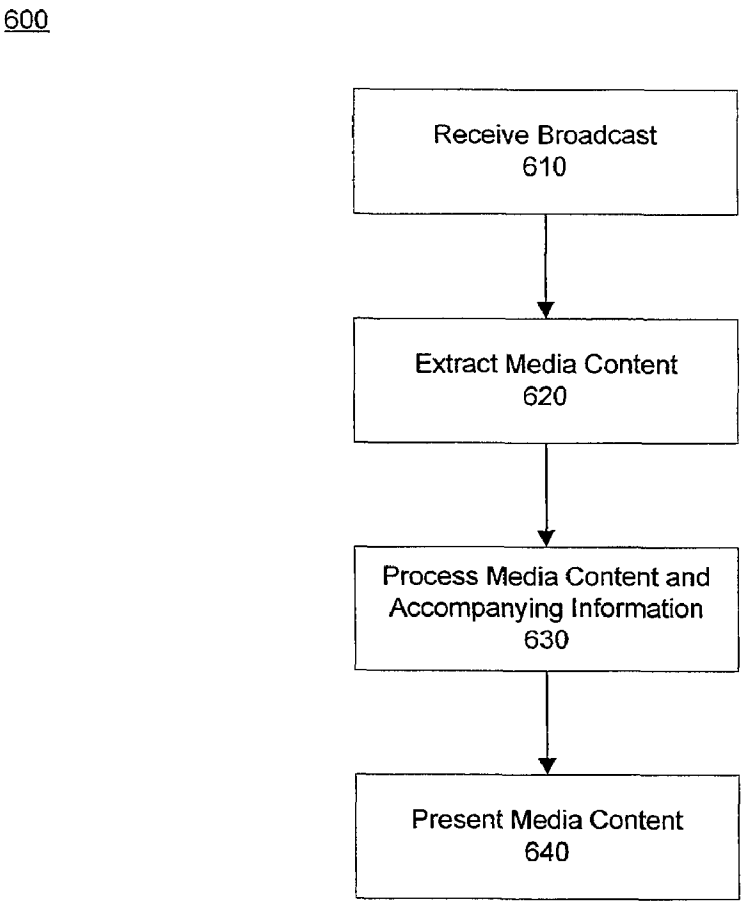
FIG. 6 illustrates an exemplary process of presenting information, consistent with the present invention.

FIG. 6 illustrates an exemplary process 600 of presenting information consistent with the present invention. As illustrated, process 600 may comprise receiving a broadcast from a network (610), extracting media content from the broadcast (620), processing the media content and accompanying information (630), and presenting the media content in accordance with the processed accompanying information (640).

Process 600 may begin when a broadcast is received from a network (610). Access terminal 350, for example, may receive a broadcast from distribution network 346. The broadcast may be received via a wireless communication link, and it may include media content (e.g., supplemental media content 330) and accompanying information associated with the media content, such as metadata associated with characteristics of the media content. In certain embodiments, receiving a broadcast (610) may involve identifying and/or scanning one or more frequency ranges (470-890 MHz and/or 1670-1675 MHz) and receiving information from one or more channels, sequentially or simultaneously.

After the broadcast is received, supplemental media content may be extracted from the broadcast (620). For example, access terminal 350 may extract supplemental media content 330 from a received broadcast from distribution network 346. The extracting (620) may include various decoding, de-encapsulation, filtering, and routing operations known in the art, which may be performed by access terminal 350.

Process 600 may also include processing the extracted supplemental media content and the accompanying information associated with the supplemental media content (630).

The accompanying information may be included in the received broadcast and may be extracted before, after, or concurrently with the media content. The processing stage (630) may involve identifying at least one characteristic associated with presenting the media content on a mobile device, such as access terminal 350. The at least one characteristic may be identified, for example, by processing an XML or other markup language document containing the media content and its associated accompanying information. The processing stage (630) may further involve processing or interpreting the accompanying information, such as the identified characteristics information. This interpreting may include interpreting XML or other markups contained in received data files in accordance with a predetermined formatting/markup scheme.

Once the media content and accompanying information are processed, the media content may be presented (640) on a mobile device in accordance with the processed accompanying information. For example, supplemental media content 330 may be presented on access terminal 350 in accordance with interpreted XML files. Presenting may include presenting visual information, audible information, and/or any other type/mode of information that can be perceived by a user, which could be an individual or an automated system.

As discussed above in connection with FIG. 4, media content may be presented such that it is displayed in a manner that is easily perceived by a user. For example, scrolling text may be presented in discrete static chunks or segments, each segment including a specific number lines of text and being displayed for a pre-determined amount of time. Scrolling text could also be converted to audible voice signals, which may be presented to a user, for example, in speech segments.

Figure 7A:
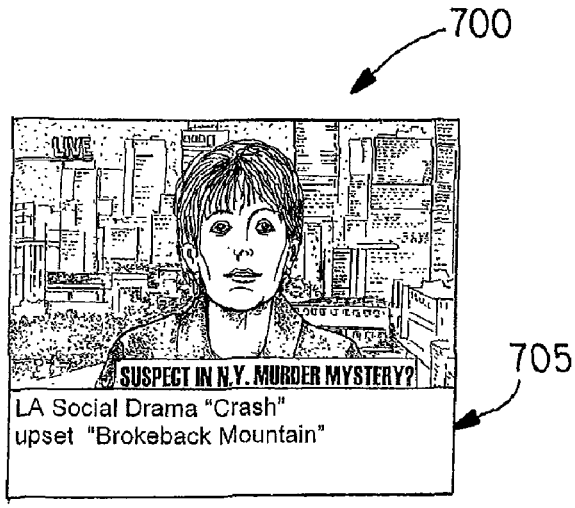
FIGS. 7A and 7B illustrate screen shots of exemplary mobile video displays consistent with the present invention.
Figure 7B:
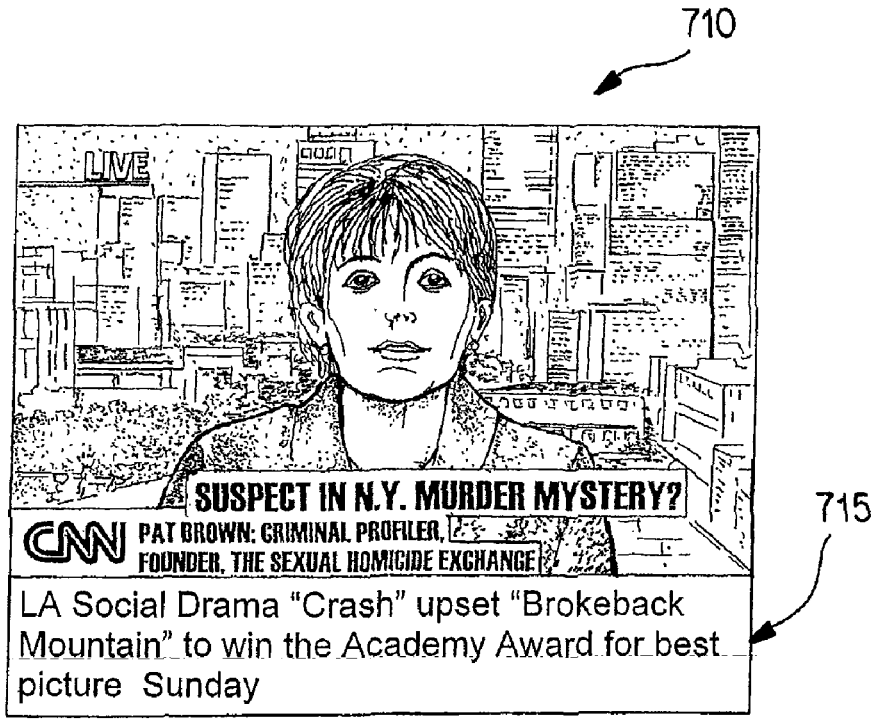

FIG. 7A illustrates an exemplary screen shot 700 of a QCIF video display, which may be provided by access terminal 350. The display in FIG. 7A may include a discrete segment 705 of scrolling text (i.e., the supplemental media content), which includes two lines of text. FIG. 7B illustrates a screen shot 710 representative of a QVGA video display, which may be provided by access terminal 350. The display in FIG. 7B may include a discrete segment 715 of scrolling text, which includes three lines of text.

The presenting stage (640) may also involve receiving one or more user commands associated with one or more user-controllable display features. Access terminal 350, for example, may receive such user commands. The user commands may specify various display preferences, such as a text size, a font style, a contrast ratio, a language, an audio signal volume, an audio signal tone, an audio signal speed, etc. The user commands may also include activation commands, which activate and de-activate the content presentation. The user commands may further include navigation commands for moving through or re-presenting the media content. For example, a user can issue a command to present previously presented content or a command to present (at one time) all content associated with a particular program and/or over a specific period of time (e.g., the last two hours). Additionally, the received user commands may include commands to overlay supplemental media content from one channel onto another channel, to search available media content feeds for user-specified keywords, and/or to perform various other available functions.

In one embodiment, presenting the media content (640) may include presenting certain accompanying information associated with the media content. For example, presenting the media content could include presenting one or more search results (obtained, e.g., by distribution infrastructure 340) received with the media content. The presenting stage (640) may further involve receiving one or more user commands associated with (e.g., responsive to) such displayed accompanying information.

FIGS. 5, 6, 7A, and 7B are consistent with exemplary implementations of the present invention. The sequence of events described in connection with FIGS. 5 and 6 is exemplary and not intended to be limiting. Other steps may be used, and even with those depicted in FIGS. 5 and 6, the particular order of events may vary without departing from the scope of the present invention. Further, the illustrated steps may overlap and/or may exist in fewer or greater steps. Moreover, certain steps may not be present and additional steps may be implemented in the illustrated methods. The illustrated steps may also be modified without departing from the scope of the present invention.

The foregoing description is not intended to be limiting. The foregoing description does not represent a comprehensive list of all possible implementations consistent with the present invention or of all possible variations of the implementations described. Those skilled in the art will understand how to implement the invention in the appended claims in many other ways, using equivalents and alternatives that do not depart from the scope of the following claims.

What is claimed is:

1. A method for presenting media content on a mobile device, the method comprising:

receiving, at the mobile device, a broadcast from a network via a wireless communication link, the broadcast including media content and metadata associated with characteristics of the media content;

extracting the media content from the broadcast;

identifying from the metadata at least one characteristic associated with formatting and presenting the media content on the mobile device;

formatting the media content for the mobile device in accordance with the at least one identified characteristic; and presenting the formatted media content on the mobile device, wherein presenting the media content comprises displaying a first segment of the media content during a first time period and displaying a second segment of the media content during a second time period subsequent to the first time period.

2. The method of claim 1, wherein the media content and the metadata are associated with a corresponding video signal and wherein receiving the broadcast comprises receiving the media content and metadata independent of the corresponding video signal.

3. The method of claim 1, wherein the at least one characteristic associated with formatting and presenting the media content on the mobile device comprises at least one of a display type for presenting the media content on the mobile device, channel association and an expiration date.

4. The method of claim 1, wherein the broadcast is transmitted over the network by a broadcast facility for reception by the mobile device, wherein the broadcast facility is configured to perform a method, the method comprising:

receiving a video signal and the media content from at least one content provider;

generating markup language files corresponding to the received media content, the markup language files including the received media content and markups associated with the metadata; and transmitting the video signal and the markup language files independently over the network for reception by the mobile device.

5. The method of claim 1, wherein extracting media content comprises extracting at least one of text corresponding to video information, an interactive data element, closed captioning information, a hypertext transfer protocol link, news bulletins, financial information, weather information, and traffic information.

6. The method of claim 1, wherein receiving the broadcast comprises receiving an eXtensible Markup Language (XML) file including the media content and markups associated with characteristics of the media content.

7. The method of claim 1, wherein presenting the media content comprises overlaying the media content on a video stream received independent from the media content.

8. The method of claim 7, wherein the media content is associated with a first channel, and wherein overlaying the media content comprises overlaying the media content on a video stream that is associated with a second channel different from the first channel.

9. The method of claim 1, further comprising:

searching for a keyword in a plurality of media content feeds associated with a plurality of network channels; and automatically tuning to an identified network channel having a media content feed that includes the keyword, wherein receiving the broadcast comprises receiving a broadcast associated with the identified network channel.

10. The method of claim 1, wherein presenting the media content comprises setting at least one of a font style, a font size, a contrast of the media content relative to a background, and a volume of an audible presentation in accordance with at least one user preference.

11. The method of claim 1, wherein presenting the media content comprises presenting segments of the media content in accordance with a navigation command issued by a user.

12. The method of claim 1, wherein receiving the broadcast from the network comprises communicating with a file transport system associated with a digital video broadcasting system.

13. A portable communication device comprising:

a receiver module configured to receive a broadcast from a wireless network, the broadcast including markup language documents representing a media content feed;

a processing module configured to extract media content and interpret the markup language documents; and a formatting and presentation module configured to format and present the extracted media content in accordance with the interpreted markup language documents, wherein the formatting presentation module displays a first segment of the media content during a first time period and displays a second segment of the media content during a second time period subsequent to the first time period.

14. The portable communication device of claim 13, wherein the media content feed includes text information.

15. The portable communication device of claim 13, wherein the media content feed includes information included in closed captioning.

16. The portable communication device of claim 13, wherein the presentation module overlays the media content feed on at least one of a video stream associated with the media content feed and a video stream unrelated to the media content feed.

17. The portable communication device of claim 13, wherein the media content feed is associated with a video feed, and wherein the receiver module is configured to receive the markup language documents and the video feed independently.

18. The portable communication device of claim 13, wherein at least one of the processing module and the presentation module is configured to:

search for a keyword in a plurality of media content feeds associated with a plurality of network channels;

activate the receiver module to tune to an identified network channel having an identified media content feed that includes the keyword; and present media content associated with the identified media content feed.

19. The portable communication device of claim 13, wherein information in the markup language documents reflects at least one of a display type for presenting the media content on the mobile device, channel association and an expiration date.

* * * * *